US005511877A

United States Patent [19]

King

[11] Patent Number: 5,511,877

[45] Date of Patent: Apr. 30, 1996

[54] STAGED ROTARY MIXER

[75] Inventor: Leonard T. King, Long Beach, Calif.

[73] Assignee: Komax Systems, Inc., Wilmington, Calif.

[21] Appl. No.: 406,495

[22] Filed: Mar. 20, 1995

[51] Int. Cl.[6] ..... B01F 5/04; B01F 7/00

[52] U.S. Cl. ..... 366/169.2; 366/172.2; 366/181.7; 366/295; 366/328.1

[58] Field of Search ..... 366/64, 66, 168.1, 366/169.1, 169.2, 170.2, 172.1, 172.2, 176.1, 181.7, 262–265, 292–295, 305, 307, 316, 328.1, 329.1, 342, 343, 181.8

[56] References Cited

U.S. PATENT DOCUMENTS 1,587,302 6/1926 Harrington ..... 366/305
1,764,020 6/1930 Hopkins ..... 366/316 X
2,153,537 4/1939 Heath et al. ..... 366/316 X
3,321,283 5/1967 Ewald ..... 366/172.1 X
4,793,713 12/1988 King ..... 366/181.8
4,886,368 12/1989 King ..... 366/295 X

*Primary Examiner*—Charles E. Cooley
*Attorney, Agent, or Firm*—Malcolm B. Wittenberg

[57] ABSTRACT

A mixing device for mixing two or more liquids. A shell body is configured with a cavity having a longitudinal axis and circular cross-section which rotatably houses a shaft. The shaft is configured along a portion of its surface with grooves for receiving liquids from inlets located within the shell body. The shaft is further provided with tubular bores for receiving one of the components to be mixed and for injecting that same component downstream within a narrow annular gap region formed between the outer surface of the shaft and the inner surface of the internal cavity in that portion of the shaft containing the slotted grooves.

7 Claims, 1 Drawing Sheet

STAGED ROTARY MIXER

Technical Field of Invention

The present invention deals with a mixing device for mixing two or more liquids. The device is configured to improve the quality of mixing by maximizing the scale and intensity of mixing of the component to be mixed. The device is particularly applicable to the mixing of component having widely contrasting viscosities.

Background of the Invention

Mixing is a term applied to actions which reduce non-uniformities of materials involved. Such materials can be liquids, solids or gases, and the non-uniformities in such materials can occur in various properties, such as color, density, temperature, etc. The quality of mixing can be described by two characteristics —scale ("S") and intensity ("I"). The scale of mixing is the average distance between the centers of maximum difference in a given property of the mixture, and the intensity is the variation in a given property of the mixture.

The terms "S" and "I" are easily understood by the following illustrations. Assume that in a shallow dish of white paint, a number of randomly dropped dollops of viscous black paint have been applied. Where all black paint with a dollop resides, the intensity "I" is one hundred percent. In regions of white paint the intensity is zero percent. The distance between the center of the black dollop and an adjacent white region is called the scale of mixing.

If the dish of paint were allowed to sit untouched, the demarkation between black and white would begin to blur as the peak or one hundred percent intensity of the black paint diminishes, and the zero intensity of the white paint rises. Finally, when enough time has passed, the intensity variation will asymptote to zero, and a uniformly gray paint mixture will result. Obviously, the smaller the scale of mixing, the more rapidly will the intensity variation asymptote to zero. Conversely, the higher the molecular diffusion, the larger the scale of mixing can be in achieving a given degree of mixedness for a given time period. Generally speaking, the higher the viscosity of a fluid, the lower will be its rate of molecular diffusion in any given solvent.

As design goals in producing the mixture of the present invention, it was the intent to reduce the scale of mixing rapidly, and thus promote a rapid drop in intensity.

The principles outlined above have particular application in the mixing of special polymers which are used in water treatment applications. These polymers are usually supplied having viscosities that can range from a few thousand centipoise to the order of one million centipoise. The polymers are generally diluted on site to save shipping costs and injected and mixed with the water to be treated as they cause; particulates in water to agglomerate to form what is called "floc," which can then be filtered.

Obviously, such high viscosity polymers are difficult to dilute on site. The conventional mechanical mixing approach, consisting of a motor driven paddle or blade in a tank, is clumsy, inefficient, and ineffective. Large lumps of undiluted polymer can circulate for hours or even days without being dissolved into solution. In addition, the very high shear rates associated with the tips of the blades can damage shear-sensitive polymers by breaking up the long chain polymers and reducing the flocculation efficiency. This is particularly true for emulsion polymers.

Even though such special polymers used in water treatment applications are introduced to, for example, ten times their own volume of water, the mixture will have a much higher viscosity than the original, undiluted matter—often ten to fifty times higher. Typical dilution ratios are 200:1. In examining this problem, it became obvious that an appropriate mixing system would be one which would break up the water/polymer elements into very small components so as to achieve a minimum scale of mixing. It was also recognized that the appropriate mixing system should be one which could provide for controlled shearing to cause a smearing of the elements together. This aids in molecular diffusion by increasing the interfacial area and by reducing interfacial thickness. It was obviously a design goal to accomplish this result in the shortest amount of time, preferably in the order of one second or less.

Parent U.S. Pat. No. 4,793,713 discloses a device for the mixing of two or more liquids which was found to be particularly effective in mixing such things as those water treatment polymers discussed previously. The device disclosed in U.S. Pat. No. 4,793,713 consists of the use of a hollow shaft connected to a drive motor which would cause the shaft to rotate. A shell body was employed to house the rotatable shaft, such shell body having inlets for the liquids to be mixed proximate one end thereof. Slotted grooves were configured within the hollow shaft for receiving the liquids to be mixed from the inlets located within the shell body. A narrow annular gap region was formed between the outer surface of the hollow shaft and the inner surface of the shell body. A first set of holes was configured in the hollow shaft located downstream of the narrow annular gap region for the introduction of the liquids into the interior of the hollow shaft. A second set of grooves configured in the hollow shaft located downstream from the first set of holes was used for dispensing the liquids from the interior of the hollow shaft and through the shell body.

The present applicant has further been awarded U.S. Pat. No. 4,886,368 which represented an advance over U.S. Pat. No. 4,793,713. In the '713 patent, significant pressure drops were measured across the mixing device as a result of channeling of the liquids to be mixed through a rather lengthy annular gap region and within the device's hollow shaft. The device shown in the '368 patent was capable of achieving excellent mixing with significantly less of a drop in pressure.

It is quite apparent in viewing the rotary mixers made the subject of both the '713 and '386 patents that they are single stage devices; that is, in each instance, fluids to be mixed are introduced in the same vicinity on the upstream side of each device and travel together while being mixed until the fluids reach the downstream or outlet ends of each mixer. It has, however, been determined that for certain applications better mixing can be achieved by going through several mixing stages. For example, one may introduce an additive A into a main component B at a concentration of, for example, ten percent, and then, in a second stage, introduce more of component B to produce a one percent final concentration. This is particularly advantageous when mixing components with high viscosity ratios and high volumetric ratios. This has been found to be particularly important in dealing with the dilution of water treatment polymers. These polymers can exhibit initial viscosities in the range of 3,000 to 30,000 times that of water. These polymers must be diluted with water in a final use ratio of at least 100:1 and sometimes over 1,000:1. Unless multiple stages are employed, these mixing operations become extremely difficult to carry out.

It is thus an object of the present invention to convert a rotary mixer, such as that shown in U.S. Pat. No. 4,886,368 into a multi-stage mixer without increasing the physical size or complexity of the original design.

This and further objects will be more readily apparent when considering the following specification and appended claims.

Summary of the Invention

The present invention deals with a device for the mixing of two or more liquids. The device comprises a shell body having upstream and downstream ends and an internal cavity, said cavity having a longitudinal axis and substantially circular cross-section.

A shaft is rotatably housed within the shell body, itself having an upstream face and downstream face of substantially circular cross-section in a longitudinal axis which coincides with the longitudinal axis of the internal cavity. The shaft is provided with slotted grooves configured along a portion of its surface for receiving the liquids to be mixed from inlets located within the shell body.

A narrow annular gap region is formed between the outer surface of the shaft and the inner surface of the internal cavity and the portion of the shaft containing the slotted grooves such that liquids tend to smear in the narrow annular gap region. The shaft is further characterized as having at least one tubular bore extending from the upstream face of the shaft and emanating from the outer surface of the shaft within the narrow annular gap region for the transport of one of the fluids to be mixed from the upstream face of the shaft to the narrow annular gap region.

Inlet means are located within the shell body for the introduction of two or more liquids to be mixed proximate the upstream end of the shell body. A liquid exist means is located proximate the downstream end of the shell body for removing the two or more liquids after mixing.

In operation, the slotted grooves located in the shaft capture some of the liquids entering the shell body while a portion of one of the liquids enters the at least one tubular bore for introduction of that liquid downstream in the narrow annular gap region thus creating a two-stage mixing device. The liquids are caused to travel down the grooves due to the hydraulic pressure imposed on the liquids at inlet. As an optional expedient, to assist the rotation of the rotor, an impeller can be provided on the drive shaft.

Detailed Description of the Invention

Figure 1:
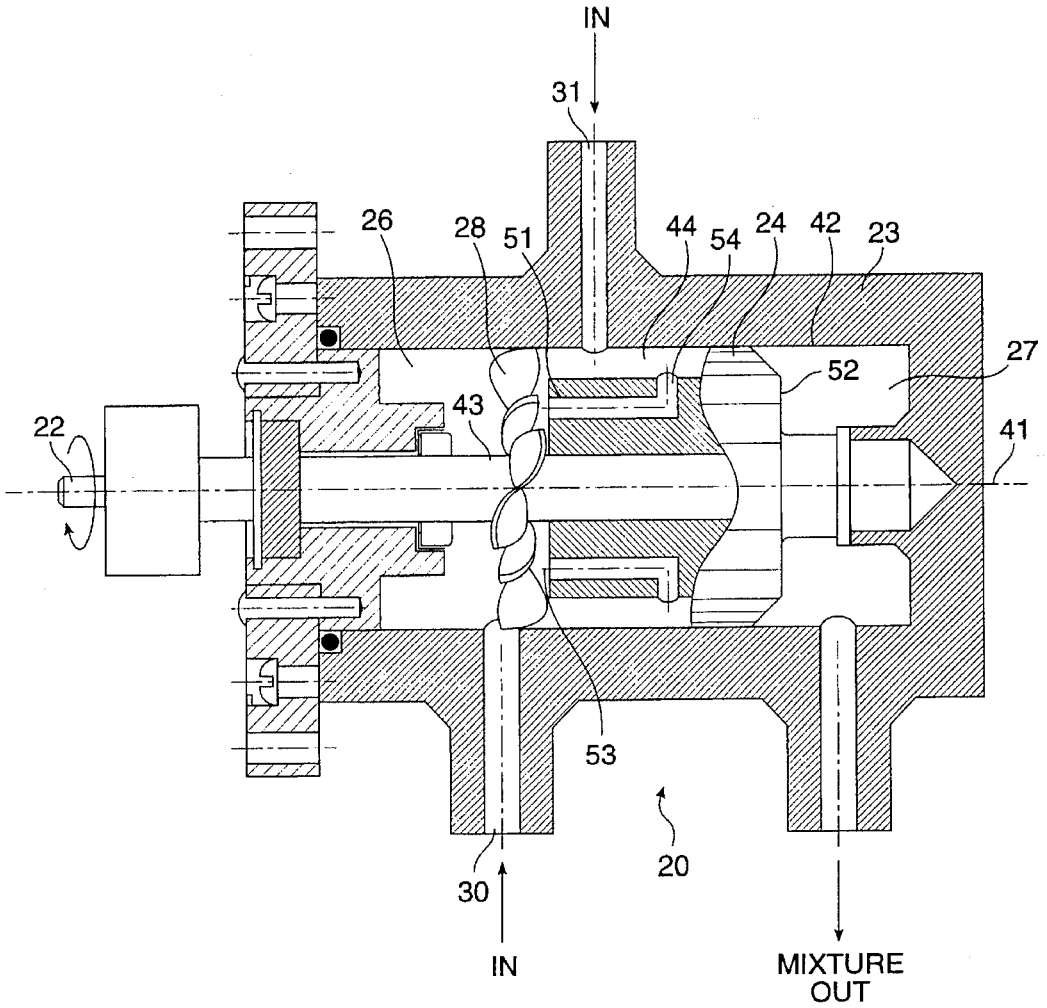
FIG. 1 represents a cross-sectional view of the mixing device of the present invention.

Turning first to FIG. 1, the basic mixing device of the present invention is shown as element 20. Drive shaft 22 can be coupled to a suitable drive motor. For most applications, drive motors in the size of 0.1 to 1.0 hp have been found to be adequate.

Outer shell 23, which can comprise a cast or forged metal housing, is provided with inlets 30 and 31 for introducing the liquids to be mixed. As an optional expedient, a pump (not shown) can be provided coupled to drive shaft 22 for introducing the polymer component in a polymer/water two-component system. When a pump is employed, the more viscous liquid, such as the polymer component in the component water two component system, would be introduced by the pump and would enter inlet 31 as shown in FIG. 1.

Turning again to FIG. 1, shell 23 is provided with internal cavity 42, said cavity having a longitudinal axis 41 and substantially circular cross-section.

Rotatable shaft 43 is provided with a longitudinal axis which substantially coincides with longitudinal axis 41 of internal cavity 42. The rotatable shaft is provided a section 44 which possesses slotted grooves 24 for receiving liquids to be mixed from inlets 30 and 31.

Figure 2:
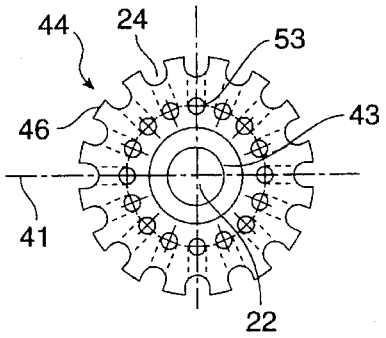
FIG. 2 represents a cross-sectional view of the shaft element of FIG. 1 taken along line 2—2 of FIG. 1.

A narrow annular gap region is formed between the outer surface of the shaft and the inner surface of the internal cavity at shaft section 44. Grooves 24 are shown as substantially semi-circular indents within the rotatable shaft wherein an annular gap is shown to appear between the perimeter of the rotatable shaft in area 44 shown partially in section at surface 46 (FIG. 2) which is at the periphery of the rotatable shaft between grooves 24 and the inner surface of shell body 23. It is noted that slotted grooves 24 and narrow annular gap region between surface 46 and the inner surface of internal cavity 42 extend from upstream face 51 to downstream face 52 of the shaft.

Rotatable shaft 43 is further provided with an upstream face 51 and downstream face 52. The shaft is provided with at least one tubular bore 53 extending from upstream face 51 of the shaft and emanating from the outer surface of the shaft within the narrow annular gap region at 54. As noted in FIG. 2, a series of tubular bores 53 are extended from upstream face 51 of the shaft, each of the tubular bores being approximately equally distanced from the longitudinal axis 41. As a preferred expedient, each of the tubular bores extend within the shaft approximately parallel to the longitudinal axis 41 for a predescribed distance preferably for approximately ½ the length of said shaft whereupon each tubular bore is angled to the surface of the shaft at 54.

As liquids are introduced, a drive motor (not shown) causes the shaft 22 to rotate and the result is the introduction of bands of the viscous component into a continuum of the low viscosity component into slotted grooves 24. In addition, a portion of the low viscosity component enters tubular bores 53, the fraction of which entering the tubular bores being a design perimeter dictated by the relationship between the diameter of the tubular bore and that of the slotted grooves.

To summarize, as liquids are introduced, a drive motor (not shown) causes the shaft 22 to rotate and the result is the introduction of bands of the viscous component into a contiguum of the low velocity component into both the slotted grooves 24 and tubular bores 53. The hydraulic pressure imposed at inlets 30 and 31 causes the liquids to progress down the slotted groove from left to right towards cavity 27 while the low viscosity component further enters the narrow annular gap region at 54. In light of the fact that very little clearance in the range of five one-thousandth of an inch is provided between peripheral surface 46 and the surface of cavity 42, the liquids tend to smear thus providing an improved scale of mixing (S). By the introduction of unmixed low viscosity component at 54, an effective two-stage mixing device is provided such that initial mixing of low and high viscosity components is carried out whereupon further dilution by the low viscosity component takes place at 54 whereupon further mixing occurs as the liquids progress downstream to cavity 27.

In a preferred embodiment, a first liquid such as water enters inlet means 30 and occupies region 26 which is a volume formed by providing shaft 43 of reduced cross-section within cavity 42. This first liquid then enters grooves 24 as well as tubular bore 53 and is mixed with a first additive such as water treatment polymer which is introduced by inlet means 31. As noted previously, mixing then takes place whereupon the water treatment polymer is further diluted by being mixed with additional inlet water at tubular bore exit 54. In effect, a two-stage mixer has now been provided by modifying a rotary mixing device which, in its initial inception, was only envisioned as being a single-stage device.

To assist the rotation of the rotor, an impeller 28 functioning as a turbine blade can be provided on drive shaft 43.

A similar cavity can be provided downstream of annular groove region 44 which is shown in FIG. 1 as volume 27. Upon reaching volume 27, virtually all of the mixing has taken place.

It is quite apparent that additional modifications could be made to the present device while remaining the spirit and scope of the present invention. For example, one could modify rotatable shaft 43 by providing tubular bores 53 which emanate within the annular gap region at staggered points within said region. In doing so, a multi-stage mixer could be provided beyond the mere two stages which is depicted in FIG. 1. Further modifications of the disclosed embodiments will be apparent to those skilled in the art and are considered to be within the scope of the invention which is to be limited only by the appended claims.

I claim:

1. A mixing device for the mixing of two or more liquids comprising a shell body having upstream and downstream ends and an internal cavity, said cavity having a longitudinal axis and substantially circular cross-section, a shaft having an upstream face and a downstream face of substantially circular cross-section, an outer surface and a longitudinal axis which coincides with said longitudinal axis of said internal cavity, said shaft being rotatably housed within said cavity, said shaft having slotted grooves configured along a portion of its outer surface for receiving the liquids to be mixed from inlets located within the shell body, a narrow annular gap region formed between the outer surface of the shaft and the inner surface of the internal cavity in the portion of the shaft containing said slotted grooves such that said liquids tend to smear in said narrow annular gap region, said shaft further having at least one tubular bore extending from the upstream face of said shaft and emanating from the outer surface of said shaft within said narrow annular gap region for the transport of one of said fluids to be mixed from said upstream face of said shaft to said narrow annular gap region, a drive shaft for connection to a suitable device and shaft for rotating said shaft within said internal cavity and said inlets located within said shell body for the introduction of said two or more liquids to be mixed proximate the upstream end of said shell body and a liquid exit means located proximate the downstream end of said shell body for removing said two or more liquids.

2. The mixing device of claim 1 wherein said shaft is provided with a region of reduced cross-section located upstream of said narrow annular gap region, said region of reduced cross-section forming an upstream volume within said internal cavity.

3. The mixing device of claim 2 wherein one of said inlets is located within said shell body at said upstream volume.

4. The mixing device of claim 3 wherein said inlet feeds a first of said two or more liquids to said upstream volume, some of which passes within said slotted grooves and some of which passes through said at least one tubular bore.

5. The mixing device of claim 1 wherein a series of tubular bores are extended from the upstream face of said shaft, each of which being approximately equally distanced from said longitudinal axis.

6. The mixing device of claim 5 wherein each of said tubular bores extend within said shaft approximately parallel to said longitudinal axis for a predescribed distance whereupon each tubular bore is angled to the outer surface of said shaft.

7. The mixing device of claim 6 wherein said predescribed distance is approximately one-half the length of said shaft.

* * * * *